US008922318B1

(12) United States Patent
Peng et al.

(10) Patent No.: US 8,922,318 B1
(45) Date of Patent: Dec. 30, 2014

(54) TRANSFORMER STRUCTURE

(71) Applicant: Delta Electronics, Inc., Taoyuan Hsien (TW)

(72) Inventors: Hsien-Chun Peng, Taoyuan Hsien (TW); Yi-Che Su, Taoyuan Hsien (TW); Zhi-Liang Zhang, Taoyuan Hsien (TW); Guang-Wei Li, Jiangsu Province (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 14/083,640

(22) Filed: Nov. 19, 2013

(30) Foreign Application Priority Data

Jun. 21, 2013 (CN) ..... 2013 1 0250211

(51) Int. Cl.
*H01F 27/29* (2006.01)
*H01F 27/30* (2006.01)

(52) U.S. Cl.
CPC ..... *H01F 27/306* (2013.01)
USPC ..... 336/192; 336/198; 336/208

(58) Field of Classification Search
USPC ..... 336/198, 208, 192, 212
See application file for complete search history.

(56) References Cited

U.S. PATENT DOCUMENTS

| | | | | |
|---|---|---|---|---|
| 3,634,878 | A * | 1/1972 | Davis | 336/192 |
| 4,546,340 | A * | 10/1985 | Kuchuris | 336/192 |
| 2008/0100407 | A1 * | 5/2008 | Yamaguchi et al. | 336/192 |

FOREIGN PATENT DOCUMENTS

| | | |
|---|---|---|
| CN | 102867625 | 1/2013 |
| TW | 201036008 | 10/2010 |
| WO | 2012036371 | 3/2012 |

* cited by examiner

*Primary Examiner* — Mangtin Lian
(74) *Attorney, Agent, or Firm* — Kirton McConkie; Evan R. Witt

(57) ABSTRACT

A transformer includes a bobbin, a winding coil assembly, a magnetic core assembly, and a bracket. The bobbin includes a supporting part and a winding part. The winding coil assembly includes a primary winding coil and a secondary winding coil. The secondary winding coil has an outlet part. The primary winding coil and the secondary winding coil are wound around the winding part of the bobbin. The magnetic core assembly includes a first magnetic core and a second magnetic core. The bobbin is arranged between the first magnetic core and the second magnetic core. The bracket is connected with the supporting part of the bobbin for assisting in positioning the outlet part of the secondary winding coil.

7 Claims, 6 Drawing Sheets

TRANSFORMER STRUCTURE

TECHNICAL FIELD

The present disclosure relates to a transformer, and more particularly to a transformer with a bracket for assisting in positioning a fly line of a secondary winding coil.

DESCRIPTION OF THE RELATED ART

A transformer is a magnetic device that transfers electric energy from one circuit to another circuit through coils in order to regulate an input voltage to a desired range for powering an electronic device.

Conventionally, the transformer comprises a bobbin, a magnetic core assembly, a primary winding coil, and a secondary winding coil. The primary winding coil and the secondary winding coil are wound around a winding part of the bobbin. During operations of the transformer, an input voltage is inputted into the primary winding coil, the magnetic core assembly is subject to electromagnetic induction, and a regulated voltage is outputted from the secondary winding coil.

FIG. 1A is a schematic exploded view illustrating a conventional transformer. FIG. 1B is a schematic perspective view illustrating the assembled structure of the transformer of FIG. 1A. As shown in FIGS. 1A and 1B, the conventional transformer 1 comprises an insulation case 10, a bobbin 11, a magnetic core assembly 12, a primary winding coil (not shown), and the secondary winding coil 13. A positioning structure 101 is protruded from a sidewall of the insulation case 10. In addition, the positioning structure 101 has positioning holes 102. A process of assembling the conventional transformer 1 will be illustrated as follows. Firstly, the primary winding coil and the secondary winding coil 13 are wound on a winding part (not shown) of the bobbin 11. In addition, the outlet parts 131 of the secondary winding coil 13 are outputted from a lateral side of the bobbin 11. After the primary winding coil and the secondary winding coil 13 are wound on the bobbin 11, the bobbin 11 and the magnetic core assembly 12 are combined together. Then, the combination of the bobbin 11 and the magnetic core assembly 12 is placed in an accommodation space 100 of the insulation case 10. In addition, the outlet parts 131 of the secondary winding coil 13 are positioned in the corresponding positioning holes 102 of the insulation case 10. The resulting structure of the assembled transformer 1 is shown in FIG. 1B. For separating the primary winding coil from the secondary winding coil 13 and meeting the safety regulations, the transformer 1 is additionally equipped with the insulation case 10. As known, the arrangement of the insulation case 10 may increase isolation and creepage distance of the transformer 1 in order to increase the electrical safety. However, the use of the insulation case 10 may increase the fabricating cost of the transformer 1 and increase the overall volume of the transformer 1.

FIG. 2 is a schematic perspective view illustrating another conventional transformer. As shown in FIG. 2, the transformer 2 comprises a bobbin 21, a magnetic core assembly 22, a primary winding coil (not shown), and the secondary winding coil 23. In addition, the transformer 2 further comprises an insulation tape 20. The function of the insulation tape 20 is similar to the function of the insulation case 10 of FIG. 1. The bobbin 21 further comprises a base 211. The base 211 is extended from the bobbin 21 along an extending direction of the outlet parts 231 of the secondary winding coil 23. Moreover, the base 211 comprises a positioning structure 212 for positioning the fly lines of the outlet parts 231 of the secondary winding coil 23. Moreover, the insulation tape 20 is wound around the bobbin 21, the magnetic core assembly 22, the primary winding coil and the secondary winding coil 23. Similarly, the insulation tape 20 may increase isolation of the transformer 2 in order to increase the electrical safety. Since the insulation case is replaced by the insulation tape 20, the fabricating cost and the overall volume of the transformer 2 are reduced when compared with the transformer 1. However, since the base 211 with the positioning structure 212 are protruded from the bobbin 21, the length and height of the transformer 2 are still large. Under this circumstance, the applications of installing the transformer 2 on a circuit board (not shown) will be restricted.

Recently, the general trends in designing electronic device are toward small size, miniaturization and slimness. Correspondingly, the volume of the transformer for use in the electronic device should be reduced. In other words, the manufactures of transformers make efforts in reducing the thicknesses of the transformers. Moreover, for facilitating assemblage, the structure of the transformer should be as simple as possible. As previously described in FIG. 1, the transformer 1 uses the insulation case 10 for isolating the primary winding coil, the secondary winding coil 13 and the external electronic components from each other and positioning the fly lines of the outlet parts 131 of the secondary winding coil 13. The insulation case 10 may increase the length, width and height of the transformer 1. As previously described in FIG. 2, the insulation case is replaced by the insulation tape 20, and the base 211 is extended from the bobbin 21. However, the length and height of the transformer 2 are still large. In other words, the conventional transformers fail to meet the requirement of miniaturization and slimness.

Therefore, there is a need of providing an improved transformer in order to avoid the above drawbacks.

BRIEF SUMMARY

The present disclosure provides a slim-type transformer that is assembled in a labor-saving and cost-effective manner.

The present disclosure also provides a transformer with a bracket for assisting in positioning a fly line of a secondary winding coil so as to overcome the positioning issues of the secondary winding coil encountered by the prior arts. Moreover, the overall volume of the transformer is reduced so as to overcome the bulk volume issues of the transformer encountered by the prior arts.

In accordance with an aspect of the present disclosure, there is provided a transformer. The transformer includes a bobbin, a winding coil assembly, a magnetic core assembly, and a bracket. The bobbin includes a supporting part and a winding part. The supporting part comprises a recess and a first positioning structure disposed within the recess. The winding coil assembly includes a primary winding coil and a secondary winding coil. The secondary winding coil has an outlet part. The primary winding coil and the secondary winding coil are wound around the winding part of the bobbin. The magnetic core assembly includes a first magnetic core and a second magnetic core. The bobbin is arranged between the first magnetic core and the second magnetic core. The bracket is connected with the supporting part of the bobbin for assisting in positioning the outlet part of the secondary winding coil. The bracket comprises a main body, an extension arm and a connecting part connected with the main body and the extension arm. The extension arm is penetrated through the first positioning structure, and the connecting part is engaged with the recess of the supporting part.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
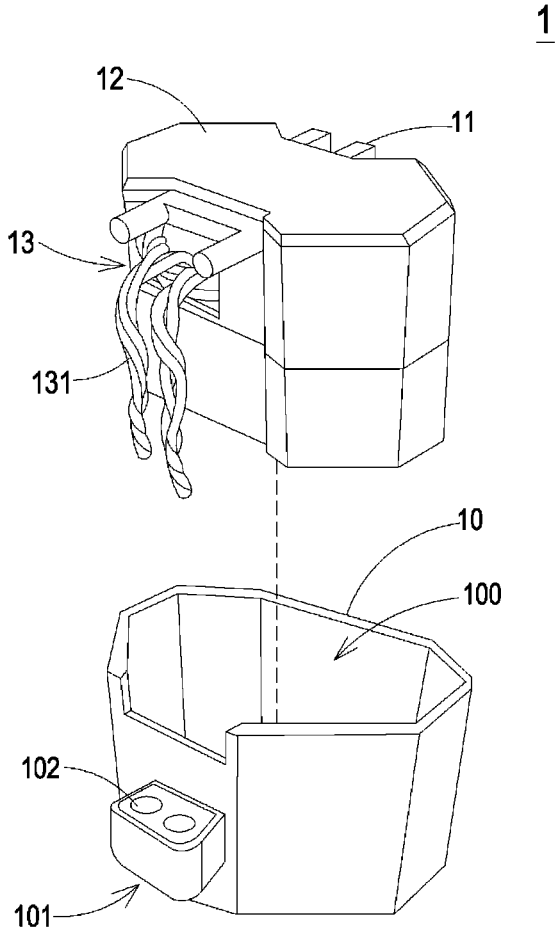
FIG. 1A (PRIOR ART)
FIG. 1A is a schematic exploded view illustrating a conventional transformer.
Figure 1B:
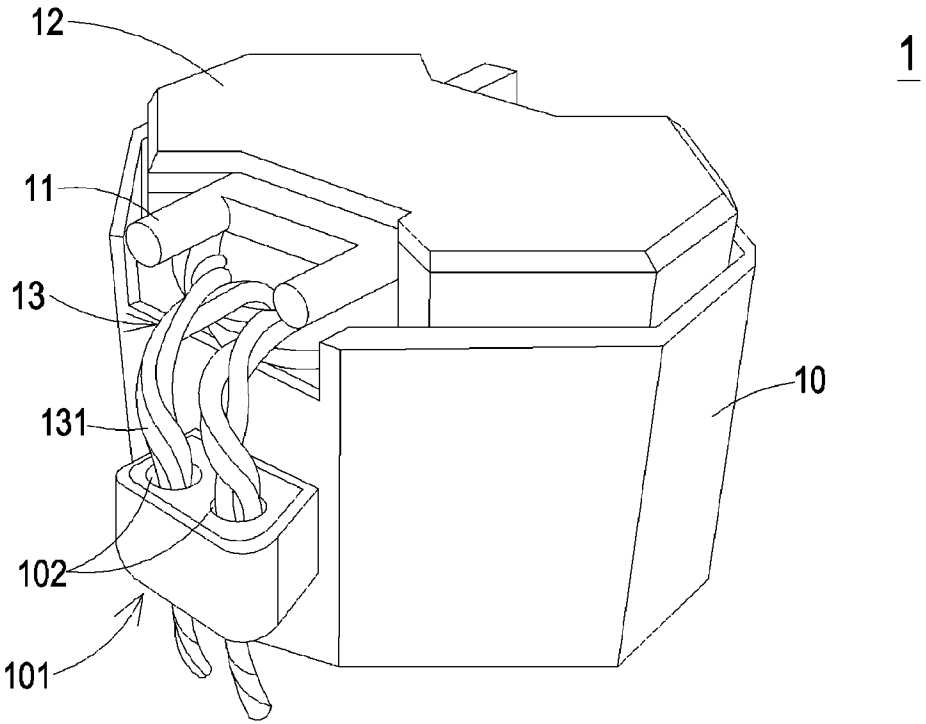
FIG. 1B (PRIOR ART)
FIG. 1B is a schematic perspective view illustrating the assembled structure of the transformer of FIG. 1A.
Figure 2:
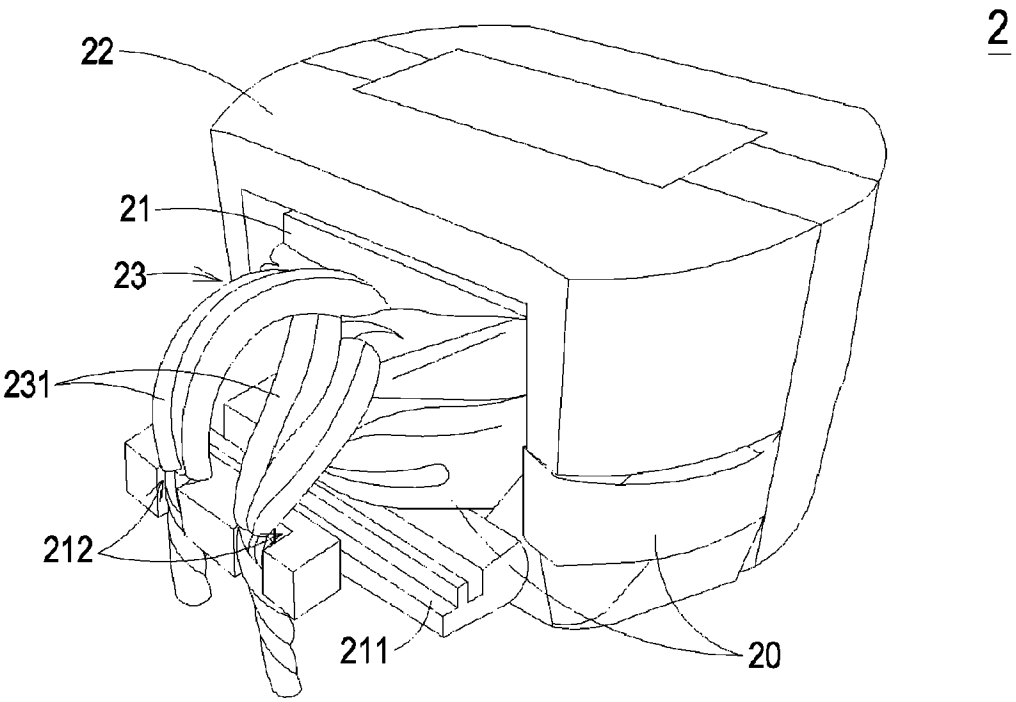
FIG. 2 (PRIOR ART)
FIG. 2 is a schematic perspective view illustrating another conventional transformer.
Figure 3:
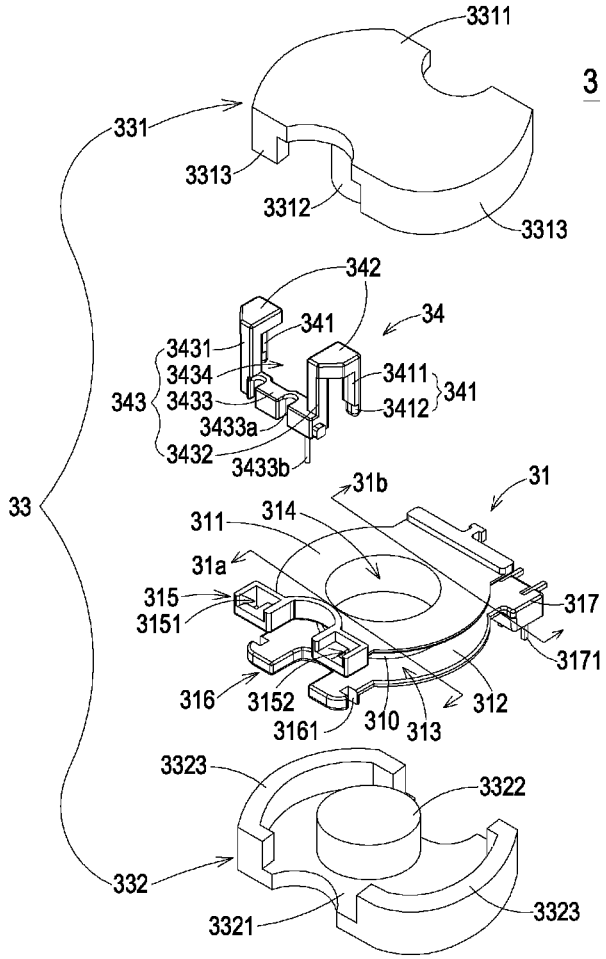
FIG. 3 is a schematic exploded view illustrating a transformer according to an embodiment of the present disclosure, in which the winding coil assembly is not shown.

FIG. 3 is a schematic exploded view illustrating a transformer according to an embodiment of the present disclosure, in which the winding coil assembly is not shown. As shown in FIG. 3, the transformer 3 comprises a bobbin 31, a winding coil assembly 32 (see FIG. 5), a magnetic core assembly 33, and a bracket 34. The bobbin 31 comprises a supporting part 315 and a winding part 313. In this embodiment, the winding coil assembly 32 comprises a primary winding coil 321 and a secondary winding coil 322 (see FIG. 5). The secondary winding coil 322 has outlet parts 3221. The primary winding coil 321 and the secondary winding coil 322 are wound around the winding part 313 of the bobbin 31. The magnetic core assembly 33 comprises a first magnetic core 331 and a second magnetic core 332. The bobbin 31 is arranged between the first magnetic core 331 and the second magnetic core 332. The bracket 34 is connected with the supporting part 315 of the bobbin 31 for assisting in positioning the outlet parts 3221 of the secondary winding coil 322. The detailed structure of the transformer 3 will be illustrated as follows.

Firstly, as shown in FIG. 3, the bobbin 31 comprises a connecting wall 310, a first stopping plate 311, and a second stopping plate 312. In this embodiment, the first stopping plate 311 and the second stopping plate 312 are ring-shaped plates. Moreover, the first stopping plate 311 and the second stopping plate 312 are opposed to each other. The connecting wall 310 is connected between the first stopping plate 311 and the second stopping plate 312. The winding part 313 is defined by the connecting wall 310, the first stopping plate 311 and the second stopping plate 312 collaboratively. Consequently, the primary winding coil 321 and the secondary winding coil 322 can be wound around the winding part 313 of the bobbin 31. Moreover, the bobbin 31 further comprises a channel 314. The channel 314 runs through the first stopping plate 311 and the second stopping plate 312. Moreover, the channel 314 is enclosed by the connecting wall 310. The magnetic core assembly 33 is partially accommodated within the channel 314. In this embodiment, the connecting wall 310, the first stopping plate 311 and the second stopping plate 312 of the bobbin 31 are integrally formed into a one-piece structure. Alternatively, in some other embodiments, the connecting wall, the first stopping plate and the second stopping plate are separate components of the bobbin.

Please refer to FIG. 3. The bobbin 31 has a first side 31*a* and a second side 31*b*, which are opposed to each other. The supporting part 315 is located at the first side 31*a*. In this embodiment, the supporting part 315 is extended from the first stopping plate 311, and located at the first side 31*a* of the bobbin 31. Moreover, the supporting part 315 is corresponding to the bracket 34.

In this embodiment, the bracket 34 comprises two extension arms 341. The two extension arms 341 are located at two sides of the bracket 34, respectively. Corresponding to the two extension arms 341, two supporting parts 315 are extended from the first stopping plate 311, and located at the first side 31*a* of the bobbin 31. Moreover, the supporting parts 315 have recesses 3151 and first positioning structures 3152 for supporting and fixing the two extension arms 341 of the bracket 34. As shown in FIG. 3, the first positioning structures 3152 are disposed within respective recesses 3151. In this embodiment, the first positioning structures 3152 are openings, but are not limited thereto. The two extension arms 341 are penetrated through the first positioning structures 3152, respectively. In this embodiment, the supporting parts 315 are integrally formed with the first stopping plate 311.

The bobbin 31 further comprises auxiliary parts 316. The auxiliary parts 316 are extended from the second stopping plate 312, and located at the first side 31*a* of the bobbin 31. The number of the auxiliary parts 316 is identical to the number of the extension arms 341 of the bracket 34. Consequently, in this embodiment, the bobbin 31 further comprises two auxiliary parts 316. Moreover, the auxiliary parts 316 have second positioning structures 3161 for assisting in positioning the corresponding extension arms 341 of the bracket 34. Examples of the second positioning structures 3161 include but are not limited to notches. After the extension arms 341 of the bracket 34 are inserted into the corresponding second positioning structures 3161, the extension arms 341 of the bracket 34 are positioned by the auxiliary parts 316. It is preferred that the auxiliary parts 316 are integrally formed with the second stopping plate 312.

Moreover, in this embodiment, the bobbin 31 further comprises a protrusion part 317. The protrusion part 317 is located at the second side 31*b* of the bobbin 31. The second side 31*b* of the bobbin 31 is opposed to the first side 31*a* of the bobbin 31. In addition, the protrusion part 317 is protruded from the second stopping plate 312. In this embodiment, the protrusion part 317 is a bulge that is protruded from the second stopping plate 312 and located at the second side 31*b* of the bobbin 31. Moreover, a plurality of pins 3171 are installed on the protrusion part 317. In particular, the pins 3171 are disposed on a bottom surface of the protrusion part 317, and connected with a circuit board (not shown). Moreover, after the outlet parts 3211 of the primary winding coil 321 (see FIG. 5) are wound around and fixed on the pins 3171, the primary winding coil 321 is electrically connected with the circuit board. It is preferred that the protrusion part 317 is integrally formed with the second stopping plate 312.

From the above discussions, even if the supporting parts 315 and the auxiliary parts 316 are locate at the first side 31*a* of the bobbin 31 and the protrusion part 317 is located at the second side 31*b* of the bobbin 31, the length of the bobbin 31 is not obviously increased because these structures are slightly protruded from the bilateral sides of the bobbin 31. In comparison with the conventional transformer, the length and height of the bobbin 31 of the transformer 3 are both reduced. In other words, the slim-type bobbin 31 is helpful to the reduction of the overall volume of the transformer 3.

Please refer to FIG. 3 again. The bracket 34 of the transformer 3 is used for assisting in positioning the fly lines of the outlet parts 3221 of the secondary winding coil 322 (see also FIG. 5). Moreover, the bracket 34 is detachably connected with the bobbin 31. In this embodiment, the bracket 34 comprises two extension arms 341, two connecting parts 342, and a main body 343. It is preferred that the two extension arms 341, the two connecting parts 342 and the main body 343 of the bracket 34 are integrally formed as a one-piece structure. Moreover, the bracket 34 is produced by a plastic injection molding process, but is not limited thereto. In this embodiment, the main body 343 of the bracket 34 has a substantially U shape. The main body 343 of the bracket 34 comprises a first lateral arm 3431, a second lateral arm 3432, and a coil-managing part 3433. The first lateral arm 3431 and the second lateral arm 3432 are opposed to each other, and in parallel with each other. Moreover, the coil-managing part 3433 is connected with an end of the first lateral arm 3431 and an end of the second lateral arm 3432. Consequently, the main body 343 of the bracket 34 has the substantially U shape. In addition, a hollow space 3434 is defined by the first lateral arm 3431, the second lateral arm 3432 and the coil-managing part 3433 of the main body 343 collaboratively. In addition, the coil-managing part 3433 comprises a plurality of positioning grooves 3433*a* for guiding and positioning the outlet parts 3221 of the secondary winding coil 322 (see FIG. 5). Moreover, the coil-managing part 3433 further comprises at least one pin 3433*b*. The at least one pin 3433*b* is disposed on the bottom surface of the coil-managing part 3433. The pin 3433*b* is fixed on the circuit board.

Moreover, the connecting parts 342 of the bracket 34 are flat plates, but are not limited thereto. The connecting parts 342 are connected with the extension arms 341 and the main body 343. As mentioned above, the main body 343 of the bracket 34 comprises the first lateral arm 3431, the second lateral arm 3432, and the coil-managing part 3433. A first end of the first lateral arm 3431 and a first end of the second lateral arm 3432 are connected with the coil-managing part 3433. A second end of the first lateral arm 3431 and a second end of the second lateral arm 3432 are connected with the connecting parts 342.

It is noted that numerous modifications and alterations of the extension arm 341 may be made while retaining the teachings of the disclosure. In this embodiment, the extension arm 341 comprises a first segment 3411 and a second segment 3412. The cross section area of the first segment 3411 is larger than the cross section area of the second segment 3412. Alternatively, in some other embodiments, the extension arm 341 is a rod with a uniform cross section area distribution. Alternatively, in some other embodiments, the extension arm 341 is a tapered rod. Moreover, in this embodiment, the extension arms 341 are in parallel with the first lateral arm 3431 and the second lateral arm 3432. Moreover, the combination of the extension arm 341, the corresponding connecting part 342 and the first lateral arm 3431 (or the second lateral arm 3432) has an inverted U-shaped structure.

Please refer to FIG. 3 again. The magnetic core assembly 33 of the transformer 3 comprises the first magnetic core 331 and the second magnetic core 332. The first magnetic core 331 comprises a magnetic plate 3311, a center leg 3312, and two lateral walls 3313. The second magnetic core 332 comprises a magnetic plate 3321, a center leg 3322, and two lateral walls 3323. The two lateral walls 3313 are located at bilateral sides of the magnetic plate 3311, and perpendicular to the magnetic plate 3311; and the two lateral walls 3323 are located at bilateral sides of the magnetic plate 3321, and perpendicular to the magnetic plate 3321. The center leg 3312 is located at a middle region of the magnetic plate 3311, and perpendicular to the magnetic plate 3311; and the center leg 3322 is located at a middle region of the magnetic plate 3321, and perpendicular to the magnetic plate 3321. Moreover, the center leg 3312 is arranged between the two lateral walls 3313; and the center leg 3322 is arranged between the two lateral walls 3323. For assembling the magnetic core assembly 33 with the bobbin 31, the center leg 3312 of the first magnetic core 331 and the center leg 3322 of the second magnetic core 332 are embedded into the channel 314 of the bobbin 31, and the bobbin 31 is enclosed by the lateral walls 3313 of the first magnetic core 331 and the lateral walls 3323 of the second magnetic core 332. Under this circumstance, only the supporting parts 315, the auxiliary parts 316 and the protrusion part 317 are exposed.

Figure 5:
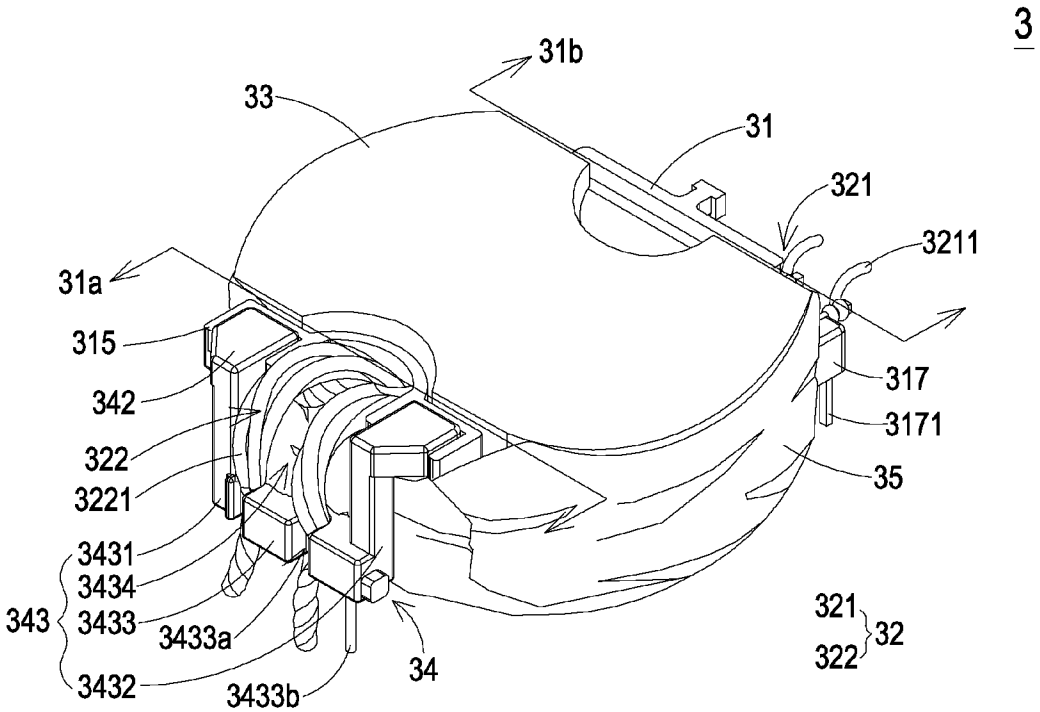
FIG. 5 is a schematic assembled view illustrating the assembled structure of the transformer of FIG. 3, in which the winding coil assembly is shown.

In this embodiment, the winding coil assembly 32 comprises the primary winding coil 321 and the secondary winding coil 322 (see FIG. 5). The primary winding coil 321 and the secondary winding coil 322 are wound around the winding part 313 of the bobbin 31. Preferably, the primary winding coil 321 and the secondary winding coil 322 are metal wires covered with insulation layers. The primary winding coil 321 has the outlet parts 3211, and the secondary winding coil 322 has the outlet parts 3221. After the primary winding coil 321 and the secondary winding coil 322 are wound around the winding part 313 of the bobbin 31, the outlet parts 3211 of the primary winding coil 321 are outputted from the second side 31*b* of the bobbin 31, and the outlet parts 3221 of the secondary winding coil 322 are outputted from the first side 31*a* of the bobbin 31 (see FIG. 5).

Figure 4:
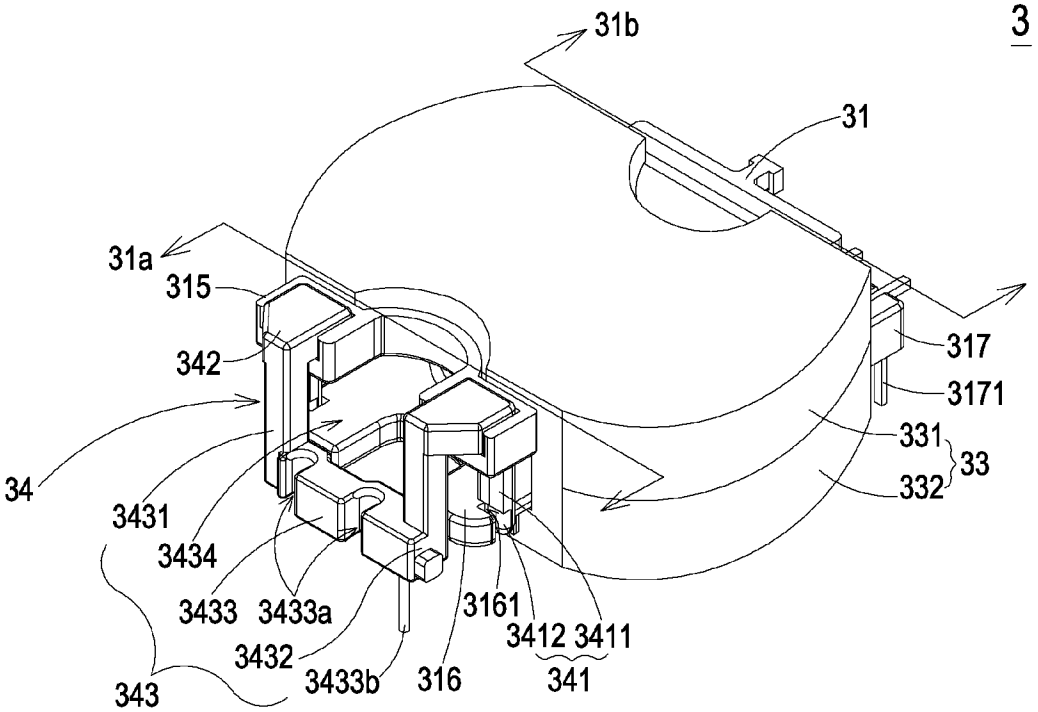
FIG. 4 is a schematic perspective view illustrating the assembled structure of the transformer of FIG. 3, in which the winding coil assembly is not shown.

FIG. 4 is a schematic assembled view illustrating the assembled structure of the transformer of FIG. 3, in which the winding coil assembly is not shown. For assembling the bracket 34 with the bobbin 31, the extension arms 341 of the bracket 34 are firstly aligned with the corresponding supporting parts 315 of the bobbin 31. Then, the extension arms 341 of the bracket 34 are penetrated through the first positioning structures 3152 (e.g. openings) of the supporting parts 315 until the connecting parts 342 of the bracket 34 are engaged with the recesses 3151 of the supporting parts 315. Meanwhile, the second segments 3412 of the extension arms 341 are engaged with the corresponding second positioning structures 3161 (e.g. notches) of the auxiliary parts 316 for assisting in positioning the extension arms 341. After the first segment 3411 of the extension arm 341 is penetrated through the first positioning structure 3152 of the corresponding supporting part 315, a portion of the first segment 3411 is accommodated within the opening of the first positioning structure 3152. Since the cross section area of the first segment 3411 is larger than the cross section area of the second segment 3412, the lower portion of the first segment 3411 is stopped by the periphery of the second positioning structure 3161, and the second segment 3412 is engaged with the second positioning structure 3161. Meanwhile, the bracket 34 is assembled with the bobbin 31. Moreover, since the connecting parts 342 of the bracket 34 are engaged with the recesses 3151 of the supporting parts 315 and the extension arms 341 are positioned by the supporting parts 315, the overall structural strength of the combination of the bracket 34 and the bobbin 31 will be enhanced. Moreover, the auxiliary parts 316 may facilitate fixing the extension arms 341, thereby assisting in securely fixing the bracket 34 on the bobbin 31. Consequently, the bracket 34 and the bobbin 31 can be stably and securely combined together.

FIG. 5 is a schematic assembled view illustrating the assembled structure of the transformer of FIG. 3, in which the winding coil assembly is shown. Hereinafter, a process of assembling the transformer 3 will be illustrated with reference to FIGS. 3 and 5. Firstly, the bobbin 31 is provided. Then, the primary winding coil 321 and the secondary winding coil 322 are wound around the winding part 313 of the bobbin 31. In addition, the outlet parts 3211 of the primary winding coil 321 are outputted from the second side 31*b* of the bobbin 31, and the outlet parts 3221 of the secondary winding coil 322 are outputted from the first side 31*a* of the bobbin 31. Then, the center leg 3312 of the first magnetic core 331 and the center leg 3322 of the second magnetic core 332 are embedded into the channel 314 of the bobbin 31, so that the bobbin 31 is securely arranged between the first magnetic core 331 and the second magnetic core 332. Then, an insulation medium 35 is attached on the bobbin 31 and the magnetic core assembly 33 for isolation. Then, the extension arms 341 of the bracket 34 are sequentially penetrated through the first positioning structures 3152 of the supporting parts 315 and the second positioning structures 3161 of the auxiliary parts 316. Consequently, the connecting parts 342 of the bracket 34 are engaged with the recesses 3151 of the supporting parts 315. At the same time, the first segments 3411 and the second segments 3412 of the extension arms 341 are engaged with the corresponding first positioning structures 3152 and the corresponding second positioning structures 3161. Meanwhile, the bracket 34 is assembled with the bobbin 31. Then, the outlet parts 3221 of the secondary winding coil 322 are outputted from the hollow space 3434 of the bracket 34 and received within the corresponding positioning grooves 3433*a* of the coil-managing part 3433. Afterwards, the outlet parts 3211 of the primary winding coil 321 are fixed on the pins 3171, and the insulation medium 35 is attached on the bobbin 31 and the magnetic core assembly 33. The resulting structure of the transformer 3 is shown in FIG. 5.

An example of the insulation medium 35 includes but is not limited to an insulation tape. The insulation medium 35 is wound around the bobbin 31 and the magnetic core assembly 33 for isolation. The insulation medium 35 may increase isolation of the transformer 3 in order to increase the electrical safety. Compare with the conventional transformer 1, since the insulation case 10 is replaced by the insulation medium 35, the fabricating cost and the overall volume of the transformer 3 of the present disclosure are reduced. Consequently, the transformer 3 of the present disclosure can meet the requirement of slimness and cost-effectiveness. Moreover, since the bracket 34 has the hollow space 3434, the material cost of the bracket 34 is reduced. Moreover, since the hollow space 3434 is not occupied by the insulation case or other partition plate, the hollow space 3434 is large enough for allowing the outlet parts 3221 of the secondary winding coil 322 to be bent downwardly and positioned in the positioning grooves 3433*a* of the coil-managing part 3433. Consequently, the outlet parts 3221 of the secondary winding coil 322 are positioned by the bracket 34 at the minimum distance. Under this circumstance, the space utilization is enhanced, and the overall volume of the transformer 3 is reduced.

From the above descriptions, the present disclosure provides a transformer. The transformer comprises a bobbin, a winding coil assembly, a magnetic core assembly, and a bracket. The bracket is assembled with the bobbin for assisting in positioning the fly lines of the outlet parts of the secondary winding coil. Since the bracket has the hollow space, the material cost of the bracket is reduced. Moreover, due to the hollow space, the outlet parts of the secondary winding coil are positioned by the bracket at the minimum distance, and the overall volume of the transformer is reduced. In addition, the bobbin used in the transformer of the present disclosure is smaller than the bobbin of the conventional transformer. Since the insulation medium is used to replace the insulation case of the conventional transformer, the fabricating cost and the overall volume of the transformer of the present disclosure are reduced when compared with the conventional transformer. In other words, the transformer of the present disclosure has reduced volume, and the secondary winding coil thereof is easily positioned. Moreover, the transformer of the present disclosure can be assembled in a labor-saving and cost-effective manner.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer, comprising:

a bobbin comprising a supporting part and a winding part, wherein said supporting part comprises a recess and a first positioning structure disposed within said recess;

a winding coil assembly comprising a primary winding coil and a secondary winding coil, wherein said secondary winding coil has an outlet part, and said primary winding coil and said secondary winding coil are wound around said winding part of said bobbin;

a magnetic core assembly comprising a first magnetic core and a second magnetic core, wherein said bobbin is arranged between said first magnetic core and said second magnetic core; and a bracket connected with said supporting part of said bobbin for assisting in positioning said outlet part of said secondary winding coil, wherein said bracket comprises a main body, an extension arm and a connecting part connected with said main body and said extension arm, wherein said extension arm is penetrated through said first positioning structure, and said connecting part is engaged with said recess of said supporting part, wherein said main body of said bracket comprises a first lateral arm, a second lateral arm and a coil-managing part, wherein said first lateral arm and said second lateral arm are opposed to each other, wherein a hollow space is defined by said first lateral arm, said second lateral arm and said coil-managing part, wherein a first end of said first lateral arm and a first end of said second lateral arm are connected with said coil-managing part, and a second end of said first lateral arm and a second end of said second lateral arm are connected with said connecting part of said bracket.

2. The transformer according to claim 1, wherein said supporting part is located at a first side of said bobbin.

3. The transformer according to claim 2, wherein said bobbin further comprises a protrusion part, wherein said protrusion part is located at a second side of said bobbin for positioning an outlet part of said primary winding coil, wherein said second side and said first side of said bobbin are opposed to each other.

4. The transformer according to claim 1, wherein said bracket is detachably connected with said bobbin.

5. The transformer according to claim 1, wherein said bobbin further comprises an auxiliary part, wherein said auxiliary part is located at a first side of said bobbin, and said auxiliary part comprises a second positioning structure for assisting in positioning said extension arm of said bracket on said bobbin.

6. The transformer according to claim 1, wherein said outlet part of said secondary winding coil is outputted from said hollow space, and received within a positioning groove of said coil-managing part.

7. The transformer according to claim 1, further comprising an insulation medium, wherein said insulation medium is wound around said bobbin and said magnetic core assembly.

* * * * *